US005221931A

United States Patent [19]

Moriyama

[11] Patent Number: 5,221,931

[45] Date of Patent: Jun. 22, 1993

[54] DRIVING METHOD FOR INK JET RECORDING HEAD AND INK JET RECORDING APPARATUS PERFORMING THE METHOD

[75] Inventor: Jiro Moriyama, Yokohama, Japan

[73] Assignee: Canon Kabushiki Kaisha, Tokyo, Japan

[21] Appl. No.: 637,956

[22] Filed: Jan. 9, 1991

Related U.S. Application Data

[63] Continuation of Ser. No. 342,814, Apr. 25 1989, abandoned.

[30] Foreign Application Priority Data

Apr. 26, 1988 [JP] Japan ..... 63-103595

[51] Int. Cl.[5] ..... B41J 2/045

[52] U.S. Cl. ..... 346/1.1; 346/140 R

[58] Field of Search ..... 346/1.1, 140

[56] References Cited

U.S. PATENT DOCUMENTS 4,521,786 6/1985 Bain ..... 346/140
4,561,025 12/1985 Tsuzuki ..... 346/140 X
4,563,689 1/1986 Murakami ..... 346/140 X
4,714,935 12/1987 Yamamoto ..... 346/140
4,897,665 1/1990 Aoki ..... 346/140

FOREIGN PATENT DOCUMENTS 176055 10/1984 Japan .
25060 2/1987 Japan .
94850 4/1988 Japan .
94851 4/1988 Japan .

*Primary Examiner*—Joseph W. Hartary
*Attorney, Agent, or Firm*—Fitzpatrick, Cella, Harper & Scinto

[57] ABSTRACT

A method of driving an ink jet head for gradient recording uses an electrical signal comprising an expanding pulse and a reducing, driving pulse. The signal is applied to a transducer such as a piezoelectric element to vary the space of an ink path and discharge ink as a droplet from a discharge port. The width and voltage of the driving pulse are only both increased or both decreased in response to changes in the recording data, with the ratio of the width to the voltage remaining constant. This driving method simplifies circuit construction, and provides for an increased range of droplet diameters and, accordingly, improved gradient recording. An apparatus for performing the method is also disclosed.

7 Claims, 5 Drawing Sheets

INPUT DATA
INPUT PULSE
(0~255)
10μS
T2=3μS 20V
40
0V
-20V
T1=10μS
6μS 40V
80
0V
DROP
DISCHARGE
9μS
60V 120
0V
12μS
80V 160
0V
DROP
DISCHARGE

INPUT PULSE
18μS
T2
T1
T2=3μS 20V
0V
−20V
T1=15μS
6μS 40V
0V
12μS
DROP
DISCHARGE
9μS 60V
0V
9μS
12μS 80V
0V
6μS
DROP
DISCHARGE

DRIVING METHOD FOR INK JET RECORDING HEAD AND INK JET RECORDING APPARATUS PERFORMING THE METHOD

This application is a continuation of application Ser. No. 07/342,814 filed Apr. 25, 1989, now abandoned.

BACKGROUND OF THE INVENTION

1. Field of the Invention

This invention relates to a method for driving, for example, an on-demand type ink jet recording head which is used in an ink jet recording device and discharges ink droplets by applying a driving voltage to an electromechanical transducing element of the head.

2. Related Background Art

FIG. 1 is a schematic upper view of an example of an ink jet recording device in general, FIG. 2 of a block diagram showing its control system.

In FIG. 1, numeral 1 is a platen which rotates in predetermined increments to enable sub-scanning during the recording of a recording medium (not shown) wound therearound. Numeral 2 is a line feed motor which rotates to the rotational shaft of the platen 1 through a gear 3. Numeral 4 is an ink jet recording head (hereinafter called "head") freely slidable on a guide bar (not shown) arranged parallel to the platen 1. The head is provided with a plurality of discharge openings or nozzles 5 for discharging ink as droplets. Numeral 6 is a belt for moving the head 5 reciprocally in the longitudinal direction of the platen 1, numerals 7 and 8 are pulleys arranged at the both ends of the belt 6, and numeral 9 a carriage motor for rotating the pulley 8.

Numeral 10 is a paper sensor for detecting the presence of recording medium arranged in the vicinity of the surface of the platen 1, numeral 11 an encoder sensor mounted on the head 4, and numeral 12 a linear encoder arranged parallel to the platen 1 and also opposed to the encoder sensor 11. Numeral 13 is a home position sensor for detecting that the head 4 is in the home position, numeral 14 is a cap which is used when restoring poor discharge including non-discharge. Numeral 15 is a motor which is the driving source for moving the cap 14 forward and backward with respect to the head 4, and numeral 16 a cap sensor for detecting that the cap 14 is mounted on the head 4.

In the above constitution, when the recording medium is mounted on the platen 1, the paper sensor 10 detects whether it is in a recording position. When the recording start button is pushed, the carriage is moved, and the head 4 moves from the home position following the printing format of the recording device, and permits ink droplets to fly from the discharge opening to reproduce the recording data. The head 4 is subjected to main scanning, driven by the belt 6 with the motor 9 as the driving source. Every time one line of main scanning is completed, the motor 2 is driven to rotate the platen 1.

To prevent clogging of the discharge openings of the head 4, the cap 14 is positioned to cover the head 4 periodically or if necessary. This state is detected by the cap sensor 16, which then interrupts the process. The restoration process comprises absorbing the ink within the nozzles by an absorbing mechanism (not shown) within the cap 14, thereby removing foreign matter etc. within the nozzles. By doing so, the restoration process prevents any defective recording.

Next, the constitution of the control system shown in FIG. 2 will be described.

CPU 20 constitutes the main body of control, to which are connected a group of switches 21 (arranged on the operational panel) through an input and output interface (not shown), a DC servo reversing circuit 22 for driving the carriage motor 9, a stepping motor driving circuit 23 for driving the line feed motor 2, a head driver 24 for driving the recording head 4 based on the recording data, a group of various sensors 25, the encoder sensor 11 and the home position sensor 13.

In the constitution shown in FIG. 2, CPU 20 performs the following operational steps corresponding to the operational input performed by the switch group 21 provided on the operational panel (not shown). More specifically, by referring to the input from the encoder sensor 11 and the home position sensor 13, the driving control of the carriage motor 9 is conducted through the DC servo reversing circuit 22, and also the driving control of the line feed motor 2 through the stepping motor driving circuit 23, whereby the recording data D are outputted to the head driver 24 to drive the recording head 4. Also, control of the other mechanisms corresponds to the inputs from another group of sensors 25.

Under this constitution, the recording process is commenced by actuating the print switch of the switch group 21. The line feed motor 2 is then driven several steps, on confirmation of the presence of recording paper by the paper sensor 10, to rotate the platen 1 and set the recording paper at the recording start position. Subsequently, the carriage motor 9 is driven to move the recording head 4 in a reciprocating manner, and the line feed motor 2 is driven as synchronized therewith to deliver the recording paper line by line. During such actuation, driving signals corresponding to the recording data are applied from the head driver 24 to drive the recording head 4, whereby ink droplets are discharged through the openings of nozzle 5 to effect recording of letters, images, etc.

FIG. 3 shows a schematic perspective view of a head unit including the nozzle of the head 4 in FIG. 1. At the tip end of the tubular ink liquid path 41, a tapered nozzle 42 is formed. On the outer surface of the nozzle 42 near the discharge opening 5, a piezoelectric element 43 for generating energy used for discharging ink is externally positioned. Also, within the inlet of the ink liquid path 41, a filter 44 is inserted to excluded foreign matters, impurities, etc. To the piezoelectric element 43 a head driver 24 is connected through a lead wire.

In the constitution in FIG. 3, ink is filled in the ink liquid path 41, and when a predetermined driving voltage is applied by the head driver 24 on the piezoelectric element 43, the piezoelectric element 43 creates a strain, thereby generating pressure in the ink liquid path 41 to discharge the ink droplets 47 from the discharge opening 5.

In this case, as shown in FIG. 4, in response to the input signal, first a voltage Vrev of negative polarity is generated for a time of T1, which voltage is applied to the piezoelectric element 43 to expand the ink liquid path 41. Next, a positive voltage Vop is generated for a time period T2, which is applied to the piezoelectric element 43 to reduce the ink liquid path 41, thereby discharging the ink as droplets 47. Further, the application voltage is gradually reduced over a time period T3, thereby effecting restoration actuation of the nozzle diameter. By setting suitably the levels of the voltages Vrev, Vop or the time period T1, T2, the ink discharging amount can be varied. For example, (1) ink droplets of greater diameter can be discharged as the time period T1 is increased corresponding to the ink discharging amount. Also (2), with Vrev equal to zero volts, and by varying the voltage Vop or the time period T2, the ink droplet discharging amount can be effectively varied.

However, in such a recording method of the prior art, in the case according to the discharging control method of example (1) as described above, when ink droplets with large diameters are desired to be discharged, the pressure change within the ink liquid path must be made very great, whereby small bubbles are generated near the filter portion and the ink discharging can be maintained stably with difficulty.

On the other hand, in the case according to the discharging control method of the above example (2), no sufficient dynamic range from ink droplets with small diameters to ink droplets with large diameters could be obtained.

SUMMARY OF THE INVENTION

It is an object of the present invention to provide a method for driving an ink jet recording head which can expand dramatically the dynamic range by enabling discharging of ink droplets stably from a small ink droplet diameter to a large ink droplet diameter.

Another object of the present invention is to provide a method for driving ink jet recording head in an on-demand type ink jet recording device which applies electrical signals corresponding to recording data on a discharging energy generating member arranged in the vicinity of a nozzle to discharge ink droplets through said nozzle, characterized in that the above electrical signals have signal waveforms ot sequentially enlarge, reduce and restore the ink liquid chamber, thereby changing the voltage value and its time width during the reduction step corresponding to the ink droplet diameter required.

Another object of the present invention is to provide an ink jet recording apparatus for carrying out the inventive method.

BRIEF DESCRIPTION OF THE DRAWINGS

FIG. 6 is a graph showing OD value characteristics comparing the first drive method of the present invention and a conventional method, FIG. 8 is a graph showing OD value characteristics comparing the second drive method of the present invention and a conventional method.

DESCRIPTION OF THE PREFERRED EMBODIMENT

The present invention enables expansion of the dynamic range by use of electrical signals applied on a discharging energy generating member having signal waveforms which sequentially enlarge, reduce and restore the ink liquid chamber and by changing the voltage value during the reduction step and its elapse of time corresponding to the ink droplet diameter required, thereby accomplishing the above object.

Further, in addition to the changing of the reduction step voltage value, by changing the actuation time during the enlargement step in inverse proportion to the size of the ink droplet size required, the dynamic range can be further expanded.

By increasing the application voltage and the elapsed time during reduction of the ink liquid chamber as greater ink droplets are required, the pressure change in the ink liquid chamber of the head can be made smaller as compared with the actuation time during expansion, ink discharging can be effected even with greater ink droplets.

Further, in addition to the change in voltage and elapsed time during the reduction step, by decreasing the actuation time during expansion as the ink droplets are made greater, the pressure change within the ink liquid chamber can be decreased further, whereby the dynamic range of the size of the ink droplets can be further expanded.

The present invention will be described in detail below with reference to FIGS. 5 to 8.

FIG. 5A to FIG. 5E are operation waveform charts corresponding to a first drive method according to the present invention.

Figure 4:
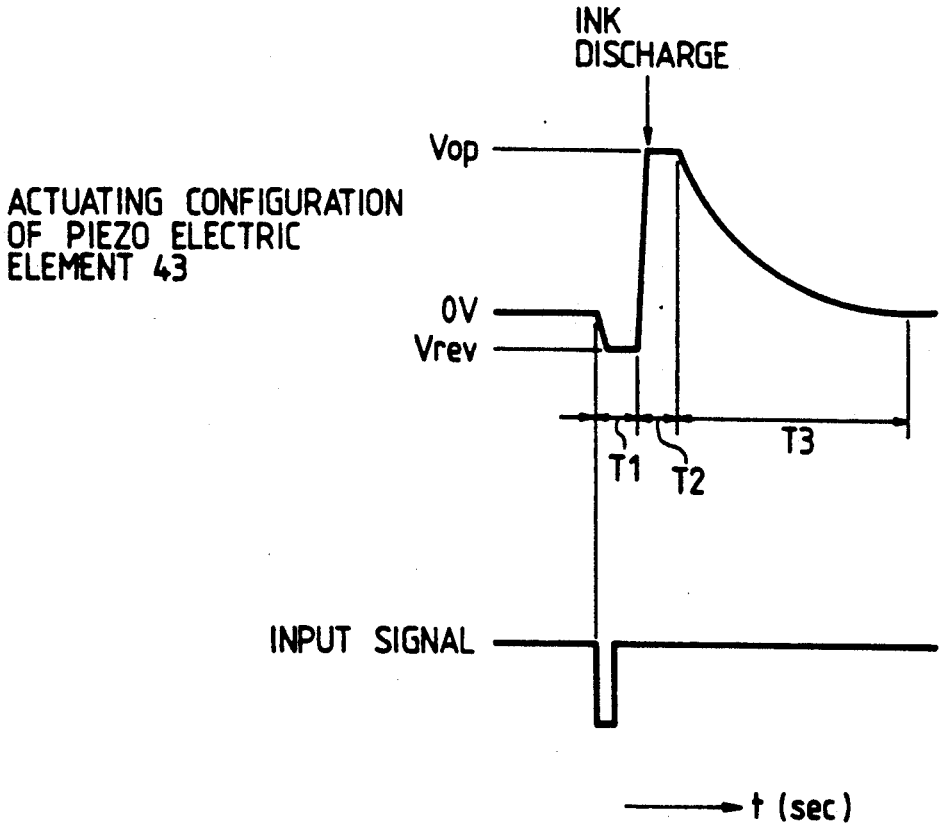
FIG. 4 PRIOR ART
FIG. 4 is a drive signal waveform chart for ink discharge from the discharge openings of the head shown in FIG. 3, FIGS. 5A to 5E are timing charts corresponding to a first drive method of the present invention.
Figures 5A, 5B, 5C, 5D, 5E:
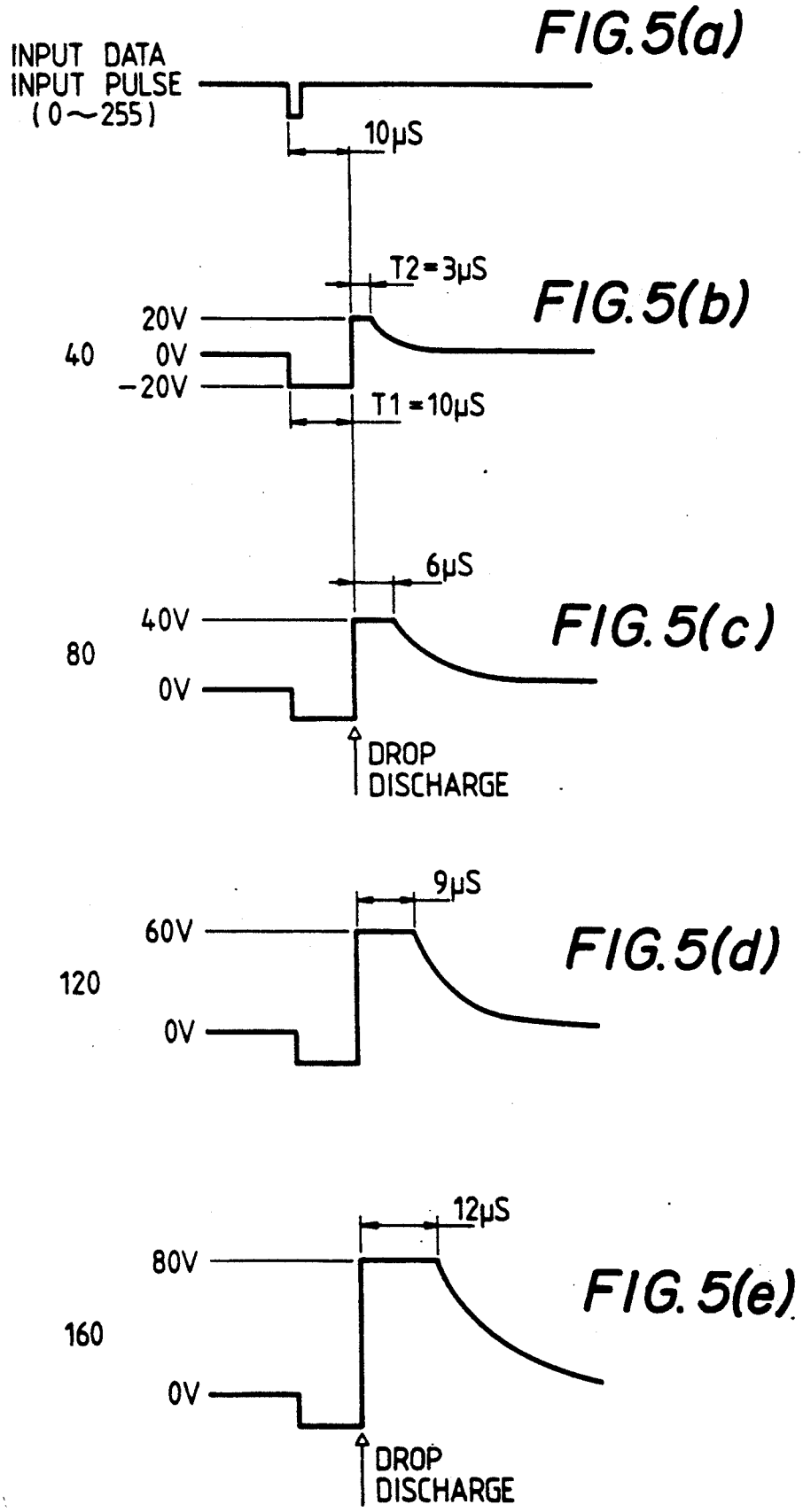

Input data D is given as a digital value of 8 bits ranging between 0 to 255, and the timing of the input pulse is shown in FIG. 5A. Of the setting values shown in FIG. 4, Vrev and T1 are constant values, and are determined to be Vrev = −20 V and T1 = 10 μs. Under this condition, an application voltage Vop in a contraction mode is set to be Vop = D/S (V). S is selected to equal 2. Minimum and maximum values of Vop vary depending on the viscosity of the ink use. When ink with a viscosity of 7 cps at a temperature of 25° C. is used, the minimum value of Vop (Vopmin) is about 20 V and the maximum value of Vop (Vopmax) is about 80 V, although it varies depending on the nozzle used.

If Vop is too low, ink droplets can not be discharged or are discharged at a very low speed. If Vop is too high, bubbles are taken into the ink path from the front portion of the discharge opening, and the normal recording operation is disturbed. Thus, a limiter is included so that input data D arrives between a minimum value Dmin and a maximum value Dmax. On the other hand, the operation time period T2 in the contraction mode is set to be T2 = 0.15 × D/2 (μs). Since the data D is limited by the limiter as described above, T2 is set between 3 to 12 μs.

Therefore, in this embodiment, Vop = D/2(V), and T2 = D/2 × 0.15 (μs). These parameters are simultaneously calculated and changed in accordance with the value of the data D, thereby changing the ink drop size. When the data D is input at 40, 80, 120 and 160, Vop and T2 change as shown in Table 1.

FIG. 5B to FIG. 5E show drive signal waveforms corresponding to Vop and T2 shown in Table 1. As can be seen from these waveforms, as the value of the data D is increased Vop and T2 are increased, and the size of an ink drop discharged from a discharge opening of the head is increased.

TABLE 1

| Data D | Application Voltage Vop in Contraction Mode | Lapse Time T2 in Contraction Mode |
|---|---|---|
| 40 | 20 V | 3 μs |

TABLE 1-continued

| Data D | Application Voltage Vop in Contraction Mode | Lapse Time T2 in Contraction Mode |
|---|---|---|
| 80 | 40 V | 6 μs |
| 120 | 60 V | 9 μs |
| 160 | 80 V | 12 μs |

When Vop and T2 are obtained from the data D, a 10 μs pulse is generated by a timer circuit in synchronism with an input pulse, and this pulse is represented by T1. A pulse $T2=0.15\times D/2$ (μs) is generated by a counter in accordance with the data D. Simultaneously, a voltage $Vout=0.5\times D$ is applied to a D/A converter in a head driver 24. The head driver 24 drives a piezoelectric element 43, having a capacitance of about 500 pF, on the basis of the above signal.

A value of 13.33 MHz is used for a master clock of CPU 20, and frequency of the clock is 0.075μ sec.

T2 is determined as $T2=0.15\times D/2\mu$ sec which is equal to the master clock of CPU 20, thus they are used in common. If value of 26.67 MHz is selected for the master clock the value made by dividing this value into two is used for determining T2 to use them in common.

Thus, since varying rate of the Vop relative to the input data and varying rate of the T2 are selected as equal, such that the ratio of the width to the voltage remains constant, the circuit construction of the head driver can be minimized.

FIG. 6 is a graph showing the relationship between a change in value of the data D and an optical reflection density (OD) value, and exemplifies a cyan color. In this case, T2= 10 μs, and ink drops have a one-to-one correspondence in the present invention and the prior art (note that the OD value means output characteristics i.e. characteristics corresponding to the diameter of the ink droplet from the recording apparatus.

As can be seen from FIG. 6, in the prior art, a value of a range ratio of R0 of an OD maximum value to an OD minimum value is $Ro=1.1/0.5=2.2$, while in this embodiment, a value of ratio R1 is $R1=1.14/0.25=4.56$. Therefore, $4.56/2.2\approx 2.1$ (times), i.e. the range ratio of this embodiment is twice or more that of the prior art.

A second embodiment of the present invention will now be described with reference to FIG. 7. In this embodiment, an interval of the time period T1 is also controlled in addition to the above embodiment.

Figure 1:
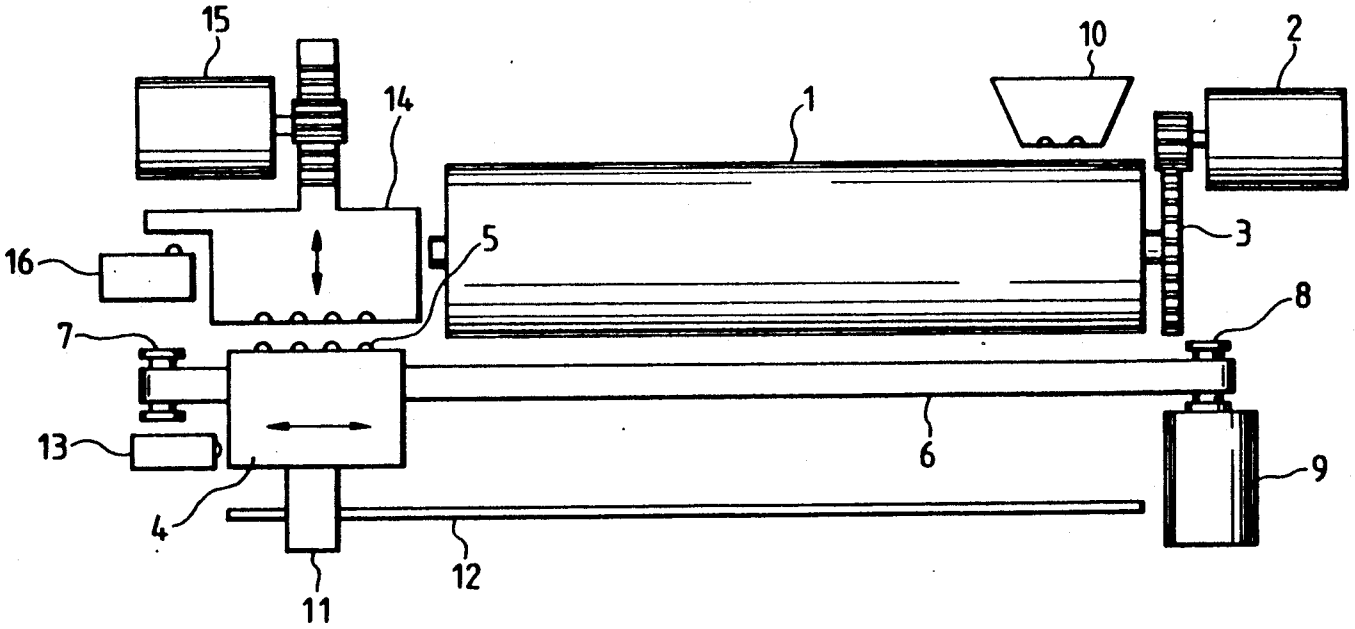
FIG. 1 PRIOR ART
FIGS. 1 and 2 are respectively a front view of an ink-jet recording apparatus and a block diagram showing its control system.
Figure 2:
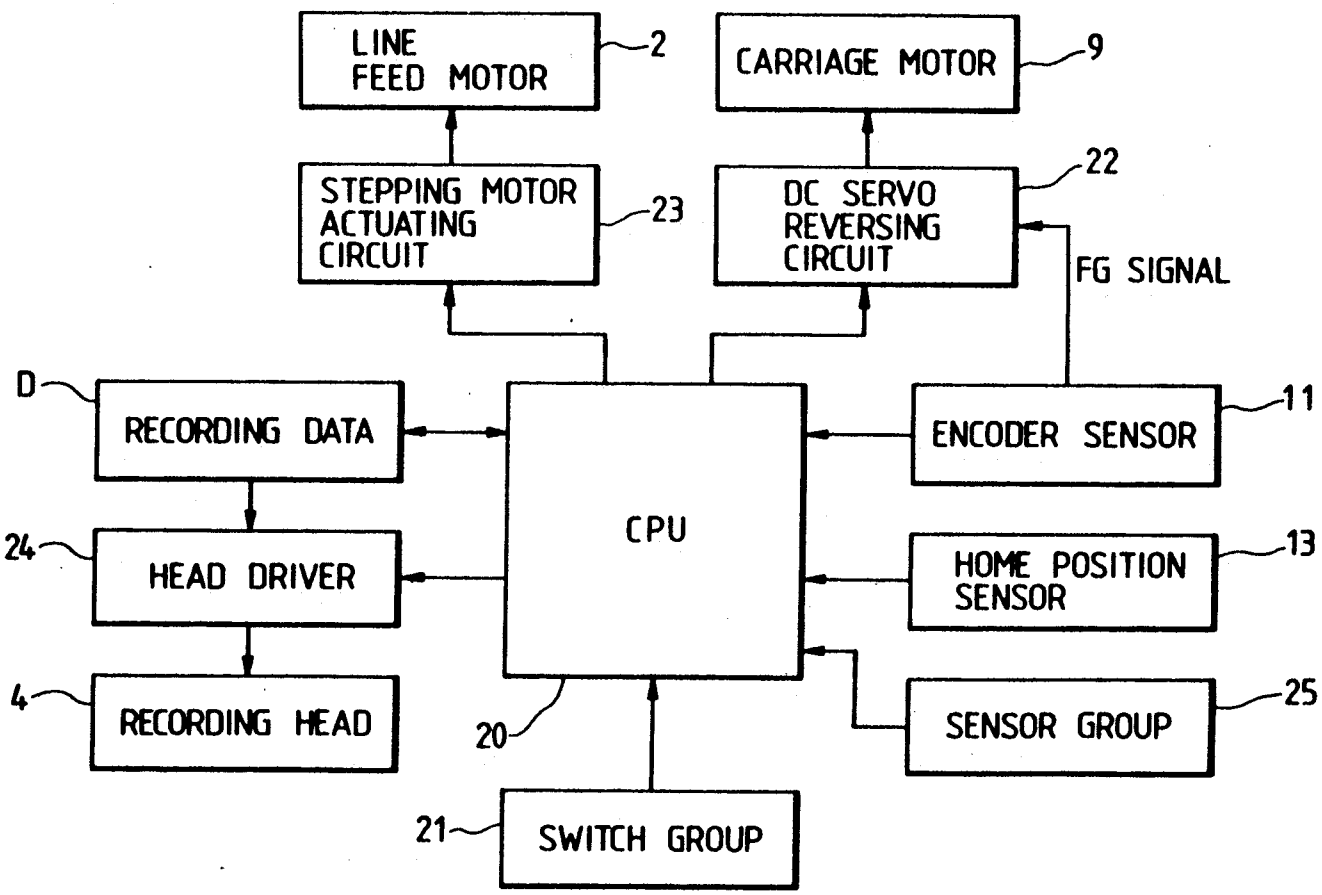
FIG. 2 PRIOR ART
Figures 7A, 7B, 7C, 7D, 7E:
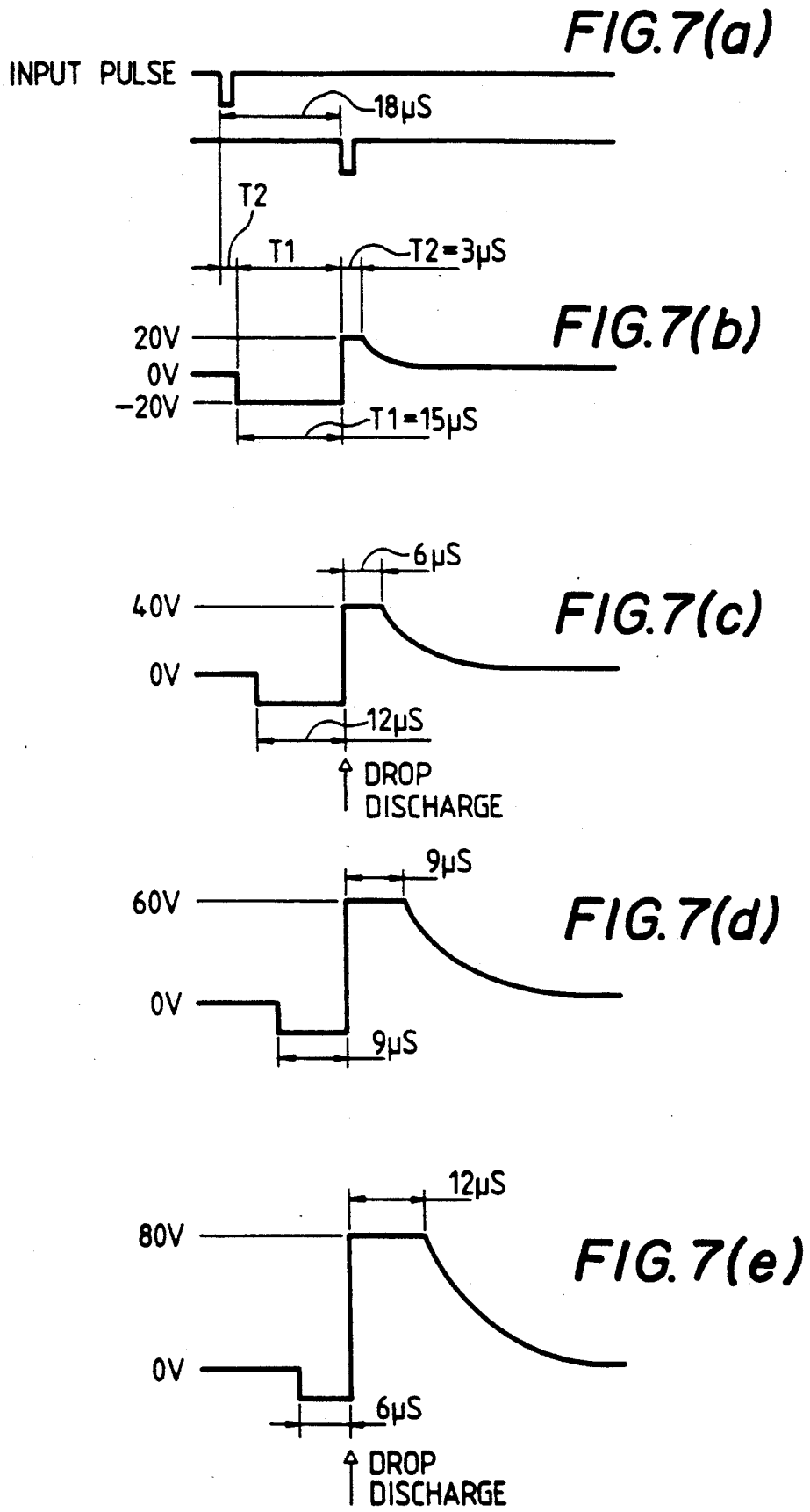
FIGS. 7A to 7E are timing charts corresponding to a second drive method of the present invention.

As shown in FIG. 7A, the generation interval of input pulses is set to be longer than that (10 μs) in FIG. 1A with respect to the generation interval of the voltage Vop, i.e., 18 μs, and the generation timing of the time T1 is set with reference to this interval or period. The time interval T1 is decreased as the value of data D is increased, as shown in FIGS. 7B to 7E. On the other hand, Vop and T2 are increased as the data D is increased like in FIGS. 5B to 5E. Furthermore, since $T1+T2=18$ μs, Vop, T2 and T1 are changed according to the input data value, and a single counter circuit (not shown) independently operated in correspondence with each nozzle can be used for each nozzle in a head driver 24, thus simplifying the arrangement.

In addition, since the varying rate of the Vop relative to the input data and the varying rates of the T1 and T2 are equal, the size of the circuit construction of the head driver can be minimized.

The driving method according to the second embodiment will now be described.

Figure 3:
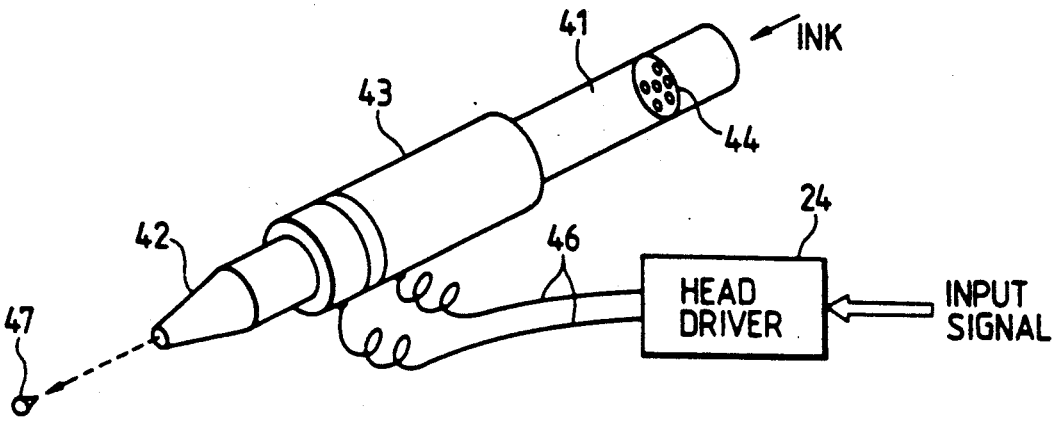
FIG. 3 PRIOR ART
FIG. 3 is a perspective view of a head unit including the nozzle of the head shown in FIG. 1.

When an input pulse is supplied, as shown in FIG. 7A, an expansion voltage having a time interval T1 (15 μs) is generated after the lapse of the time T2 is synchronism with the input pulse, thus expanding the ink path 41. Vop having an inverted voltage polarity is generated to have the time interval T2 (3 μs) to contract the ink chamber 41, and an ink drop 47 is discharged and flies from the discharge opening 42, as shown in FIG. 3. Then, a recovery operation is performed ready the head for the next discharge operation.

In this manner, the time interval T2 is used twice in the injection process, so that a single timer circuit can be used twice, thus simplifying the arrangement. These circuits are provided for nozzles of ink colors of cyan, magneta, yellow, and black.

In this embodiment, an ink injection timing pulse is reached 18 μs after the input of the input pulse, and is delayed 8 μs as compared to the first embodiment. This can be corrected by any method.

When the data D is increased, the time interval T1 can be changed, as shown in FIGS. 7C to 7E. In this manner, when T1 is decreased as Vop and T2 are increased, a variation in pressure in the ink path can be relatively small. Therefore, a large ink drop can be stably ejected.

Therefore, as shown in FIG. 8, the range ratio R2 of an OD maximum value to an OD minimum value is $1.40/0.25=5.6$. In this manner, a dynamic range can be further extended as compared to FIG. 6. In particular, an increase in output OD value at a high input data side is an indication of an effect caused by decreasing the time interval T1.

Note that conditions in FIGS. 7A to 7E are as follows:

$$Vrev=-20\text{ V (constant)},\ Vop=0.5\times D$$

$$T1=18-T2\ (\mu s)$$

$$T2=0.15\times D/2\ (\mu s)$$

$$T1+T2=18\ \mu s\ \text{(constant)}.$$

In the above embodiment, the sum or total of T1 and T2 are made in constant, but this is true only under the condition that the viscosity of the ink is 7 cps at 25° C. In general, viscosity of the ink varies depending on temperature. As temperature is lower and, therefore, viscosity is lower, it is desirable to select a smaller sum of T1 and T2 to obtain the above advantage. Ink temperature is transmitted to CPU 20 as a digital signal by a temperature sensor provided in the sensor group 25. Because the varying rate of the ink temperature relative to time is small, the value of the sum of T1 and T2 is determined corresponding to the digital signal transmitted just before recording starts to record at a constant value, on a designated, discreet area (here, one sheet of size A4).

As can be apparent from the above-description, an electrical signal applied to the head forms a signal waveform for sequentially expanding, contracting and recovering the ink chamber, and both a voltage value and its time interval in the contraction mode of the ink path are changed in accordance with a required ink drop size. Thus, a dynamic range can be significantly extended from a small ink drop to a large ink drop.

In addition to the injection control, the time interval of the expansion step of the ink path is decreased as the ink drop size is increased, thus further extending the dynamic range.

Thus, according to the present invention, the driving method of the ink jet recording head which allows better gradient recording.

I claim:

1. A driving method for an ink jet recording head including control means for applying electric signals corresponding to input recording information to an ink jet recording head having an electric converting element provided to vary the space of an ink path through which the ink flows to perform gradient recording, said method comprising:

varying the space of the ink path for discharging ink as a droplet by energizing the electric converting element with a driving pulse for reducing the space of the ink path, wherein the width and the voltage of the driving pulse are only both increased or both decreased in response to a change in the input recording information, and wherein a ratio of the width to the voltage remains constant.

2. A driving method for an ink jet recording head according to claim 1, wherein in energizing the electric converting element, a ratio of increased driving pulse width to decreased driving pulse width and a ratio of increased voltage to decreased voltage are the same.

3. A driving method for an ink jet recording head according to claim 2, wherein said driving method is performed by using an electric-mechanical converting element as said electric converting element, said method further comprising the steps:

increasing the space of the ink path, in response to an expanding pulse applied to the electric-mechanical converting element prior to application thereto of the driving pulse, the sum of the pulse width t1 of the expanding pulse and the pulse width t2 of driving pulse being made constant for a predetermined temperature; and changing the value of the sum of the expanding pulse width t1 and the driving pulse width t2 with changing temperature.

4. A deriving method for an ink jet recording head according to claim 3, wherein in energizing the electric converting element the driving pulse voltage is within a range of 20 V to 80 V.

5. A driving method for an ink jet recording head according to claim 1, wherein said driving method is performed by using an electric-mechanical converting element as said electric converting element, said method further comprising the steps of:

increasing the space of the ink path, in response to an expanding pulse applied to the electric-mechanical converting element prior to application thereto of the driving pulse, the sum of the pulse width t1 of the expanding pulse and the pulse width t2 of driving pulse being made constant for a predetermined temperature; and changing the value of the sum of the expanding pulse width t1 and the driving pulse width t2 with changing temperature.

6. A driving method for an ink jet recording head according to claim 5, further comprising the steps of:

decreasing the value of the sum of the expanding pulse width t1 and the driving pulse width t2 corresponding to an increase in temperature; and increasing the value of the sum of t1 and t2 corresponding to a decrease in temperature.

7. An ink jet recording apparatus comprising:

an ink jet recording head having an electric converting element provided to vary the space of an ink path through which ink flows to perform gradient recording; and control means for applying to said electric converting element electric signals corresponding to input recording information to vary the space of said ink path and discharge ink as a droplet by energizing said electric converting element with a driving pulse for reducing the space of said ink path, wherein the width and the voltage of the driving pulse are only both increased or both decreased in response to a change in the input recording information, and wherein a ratio of the width to the voltage remains constant.

* * * * *

UNITED STATES PATENT AND TRADEMARK OFFICE

CERTIFICATE OF CORRECTION

PATENT NO. : 5,221,931

DATED : June 22, 1993

INVENTOR(S) : JIRO MORIYAMA

It is certified that error appears in the above-indentified patent and that said Letters Patent is hereby corrected as shown below:

In the Drawings:

BETWEEN SHEETS 4 and 5

Insert Fig. 6:

-- FIG. 6

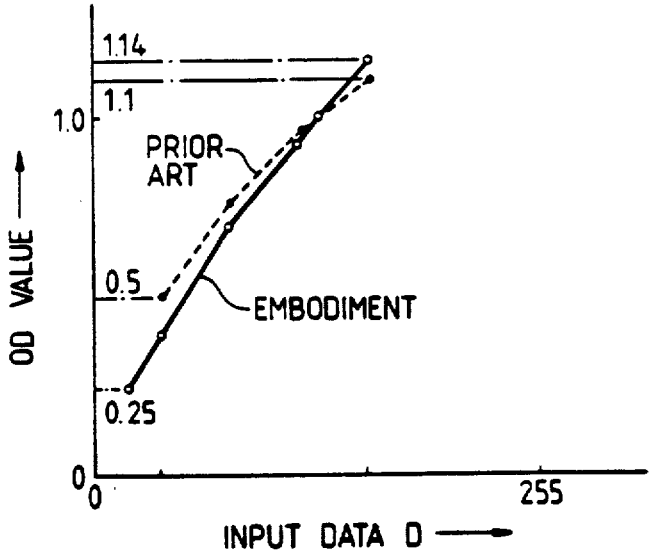

--.

UNITED STATES PATENT AND TRADEMARK OFFICE

CERTIFICATE OF CORRECTION

PATENT NO. : 5,221,931

DATED : June 22, 1993

INVENTOR(S) : JIRO MORIYAMA

It is certified that error appears in the above-indentified patent and that said Letters Patent is hereby corrected as shown below:

In the Drawings:

AFTER SHEET 5

Insert Fig. 8:

-- FIG. 8

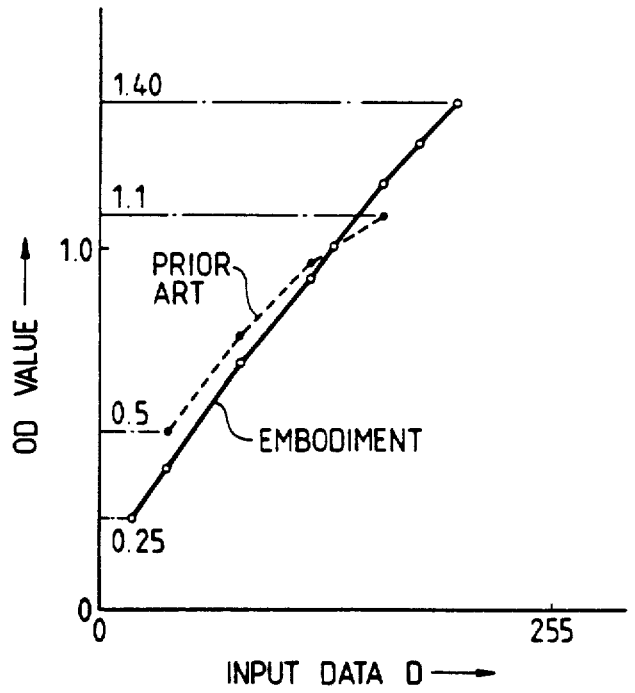

--.

UNITED STATES PATENT AND TRADEMARK OFFICE

CERTIFICATE OF CORRECTION

PATENT NO. : 5,221,931

DATED : June 22, 1993

INVENTOR(S) : JIRO MORIYAMA

It is certified that error appears in the above-identified patent and that said Letters Patent is hereby corrected as shown below:

COLUMN 2

Line 45, "excluded" should read --exclude--.

COLUMN 6

Line 5, "is" (second occurrence) should read --in--.
Line 11, "ready" should read --to ready--.
Line 46, "in" should be deleted.
Line 59, "discreet" should read --discrete--.

COLUMN 7

Line 6, "which" should be deleted.

COLUMN 8

Line 2, "claim 3," should read --claim 1,--.

Signed and Sealed this

Thirty-first Day of May, 1994

Bruce Lehman

*Attest:*

BRUCE LEHMAN

*Attesting Officer*

*Commissioner of Patents and Trademarks*